US009217435B2

(12) United States Patent
Moore et al.

(10) Patent No.: US 9,217,435 B2
(45) Date of Patent: Dec. 22, 2015

(54) AXIAL FLOW PUMP WITH INTEGRATED MOTOR

(71) Applicant: Nidec Motor Corporation, St. Louis, MO (US)

(72) Inventors: William D. Moore, Florissant, MO (US); Jason A. Richter, Glen Carbon, IL (US); Joshua M. Biro, Wood River, IL (US)

(73) Assignee: Nidec Motor Corporation, St. Louis, MO (US)

( * ) Notice: Subject to any disclaimer, the term of this patent is extended or adjusted under 35 U.S.C. 154(b) by 269 days.

(21) Appl. No.: 13/658,715

(22) Filed: Oct. 23, 2012

(65) Prior Publication Data

US 2014/0112808 A1 Apr. 24, 2014

(51) Int. Cl.
*F04D 13/06* (2006.01)
*F04D 3/00* (2006.01)

(52) U.S. Cl.
CPC ..... *F04D 3/00* (2013.01); *F04D 13/0606* (2013.01)

(58) Field of Classification Search
CPC ..... F04D 13/06; F04D 3/005; F04D 3/00; F04D 13/0606; F04D 3/02
USPC ..... 417/355–356
See application file for complete search history.

(56) References Cited

U.S. PATENT DOCUMENTS 3,143,972 A 8/1964 Smith et.al.
4,831,297 A 5/1989 Taylor et al.
5,075,606 A 12/1991 Lipman
5,185,545 A 2/1993 Veronesi et al.
5,205,721 A 4/1993 Isaacson
5,209,650 A * 5/1993 Lemieux ..... F01D 15/10 384/115
5,211,546 A 5/1993 Isaacson et al.
5,252,875 A 10/1993 Veronesi et al.
5,289,068 A 2/1994 Veronesi et al.
5,490,768 A 2/1996 Veronesi et al.
5,494,413 A * 2/1996 Campen et al. ..... 417/356
5,527,159 A 6/1996 Bozeman, Jr. et al.
5,692,882 A 12/1997 Bozeman, Jr. et al.
6,053,705 A 4/2000 Schob et al.
6,250,880 B1 6/2001 Woodard et al.
6,254,359 B1 * 7/2001 Aber ..... 417/356
6,368,075 B1 4/2002 Fremerey
6,595,743 B1 * 7/2003 Kazatchkov ..... F04D 3/00 415/170.1
6,638,011 B2 10/2003 Woodard et al.
6,813,328 B2 11/2004 Kitch et al.
6,966,748 B2 11/2005 Woodard et al.
7,226,277 B2 6/2007 Dooley
7,235,894 B2 6/2007 Roos
7,385,303 B2 6/2008 Roos
7,438,538 B2 10/2008 Dooley
7,476,077 B2 1/2009 Woodard et al.
7,502,648 B2 3/2009 Okubo et al.
7,568,896 B2 8/2009 Dooley
7,794,214 B2 9/2010 Dooley
8,002,518 B2 8/2011 Woodard et al.
8,007,254 B2 8/2011 LaRose et al.
8,157,539 B2 4/2012 Hidaka et al.
2004/0203298 A1 10/2004 Chaix
2005/0025630 A1 2/2005 Ayre et al.

(Continued)

*Primary Examiner* — Charles Freay
*Assistant Examiner* — Philip Stimpert
(74) *Attorney, Agent, or Firm* — Hovey Williams LLP

(57) ABSTRACT

An appliance containing a motorized appliance pump is provided. The appliance pump includes an integrated motor. The pump is an axial flow pump operable to move fluid along a fluid passageway.

29 Claims, 9 Drawing Sheets

(56) References Cited

U.S. PATENT DOCUMENTS

| | | | |
|---|---|---|---|
| 2005/0196293 | A1 | 9/2005 | Ayre et al. |
| 2007/0086902 | A1 | 4/2007 | Dooley |
| 2010/0069847 | A1 | 3/2010 | LaRose et al. |
| 2010/0185280 | A1 | 7/2010 | Ayre et al. |
| 2011/0301403 | A1 | 12/2011 | LaRose et al. |
| 2012/0016178 | A1 | 1/2012 | Woodard et al. |

* cited by examiner

AXIAL FLOW PUMP WITH INTEGRATED MOTOR

BACKGROUND OF THE INVENTION

1. Field of the Invention

The present invention relates generally to appliances, such as dishwashers, and motorized appliance pumps. More specifically, the present invention concerns an appliance pump having an integrated motor.

2. Discussion of the Prior Art

Those of ordinary skill in the art will appreciate that pumps are often used in home appliances such as dishwashers and water heaters. In many instances, the pumps are driven by electric motors. Pumps used in such appliances are commonly of a centrifugal type. In such pumps, a fluid flows through an inlet line into a housing containing a rotating impeller. The impeller directs the fluid through an outlet line oriented perpendicularly to the inlet line. That is, a change in flow direction is required. Among other things, such a change leads to decreased hydraulic efficiency. Furthermore, the form of the housing of such a pump may require dedication of a detrimentally large space within the machine.

SUMMARY

According to one aspect of the present invention, an appliance comprises a fluid line presenting a fluid passageway, a mechanism coupled to the line so as to be operable to act on fluid within the passageway, and an axial flow pump operable to move fluid along the passageway. The pump includes a housing coupled to the fluid line, a motor including a rotor and a stator, and a pair of bearing systems. The housing at least in part defines a primary flow path therethrough that is fluidly connected to the passageway. The rotor includes a magnet, an elongated rotatable shaft that presents opposite ends, and an impeller fixed to the shaft for rotational movement therewith. The impeller includes a substantially annular rim that is spaced radially from the shaft and supports the magnet. The impeller further includes a blade disposed in the primary flow path. The pair of bearing systems rotatably supports the shaft on the housing, with each of the bearing systems being located adjacent a respective end of the shaft.

According to another aspect of the present invention, an appliance comprises a fluid line presenting a fluid passageway, a mechanism coupled to the line so as to be operable to act on fluid within the passageway, and an axial flow pump operable to move fluid along the passageway. The pump includes a housing coupled to the fluid line, a motor including a rotor and a stator, and a stationary bearing surface facing a generally axial direction. The housing at least in part defines a primary flow path therethrough that is fluidly connected to the passageway. The rotor includes a magnet, a stationary shaft, a sleeve bearing rotatably supported on the shaft, and an impeller fixed to the sleeve bearing for rotational movement therewith. The sleeve bearing includes a radial bearing face engaging the shaft so as to permit rotational movement of the sleeve bearing relative to the shaft. The impeller includes a substantially annular rim that is spaced radially from the sleeve bearing and supports the magnet. The impeller further includes a blade disposed in the primary flow path. The sleeve bearing includes an axial bearing face engaging the stationary bearing surface so as to permit rotational movement of the sleeve bearing relative to the stationary bearing surface while restricting relative axial movement of the sleeve bearing.

According to another aspect of the present invention, an appliance comprises a fluid line presenting a fluid passageway, a mechanism coupled to the line so as to be operable to act on fluid within the passageway, and an axial flow pump operable to move fluid along the passageway. The pump includes a housing coupled to the fluid line and a motor including a rotor and a stator. The housing at least in part defines a primary flow path therethrough that is fluidly connected to the passageway. The rotor includes an impeller and a magnet. The impeller includes a blade disposed in the primary flow path. The housing at least in part defines a fluid chamber spaced radially outward from the primary flow path, with the magnet being located generally within the chamber. The chamber is fluidly interconnected with the primary flow path by a restricted flow conduit. The flow conduit includes substantially orthogonal sections, with a first conduit section extending generally radially outward from the primary flow path and a second conduit section extending from the first section in a generally axial direction, such that fluid is prevented from flowing linearly from the primary flow path to the chamber.

This summary is provided to introduce a selection of concepts in a simplified form. These concepts are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 2:
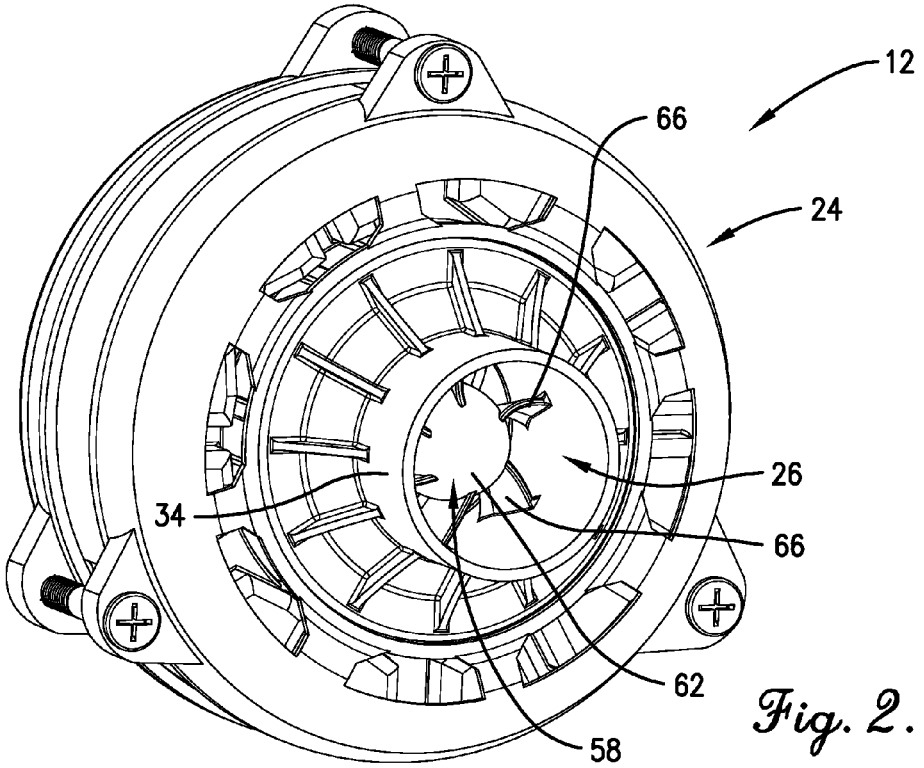
FIG. 2 is a front perspective view of an electric pump constructed in accordance with the principles of a first embodiment of the present invention.
Figure 3:
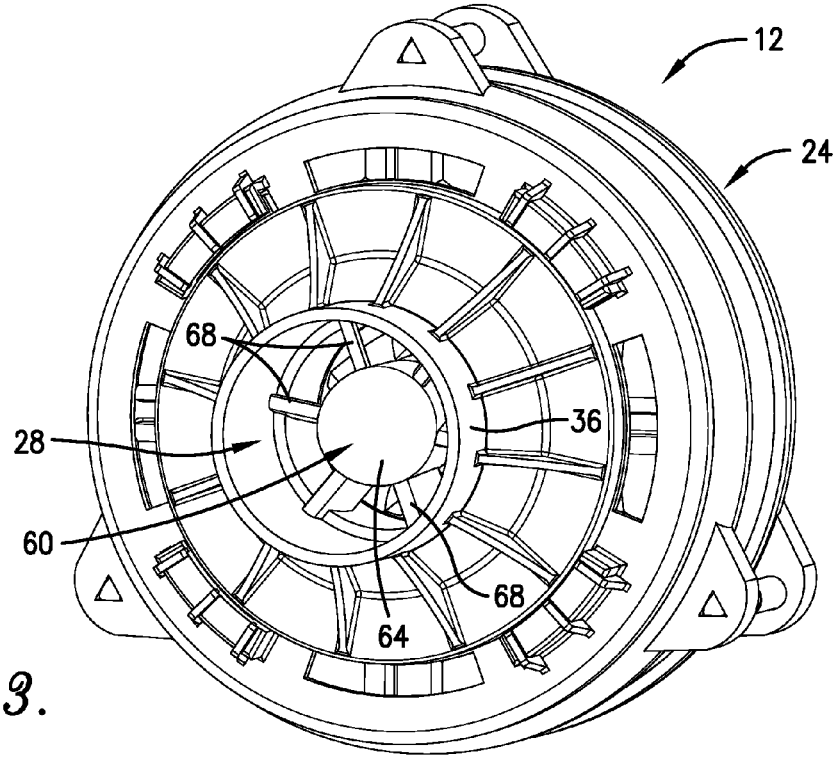
FIG. 3 is a rear perspective view of the electric pump of FIG. 2.
Figure 4:
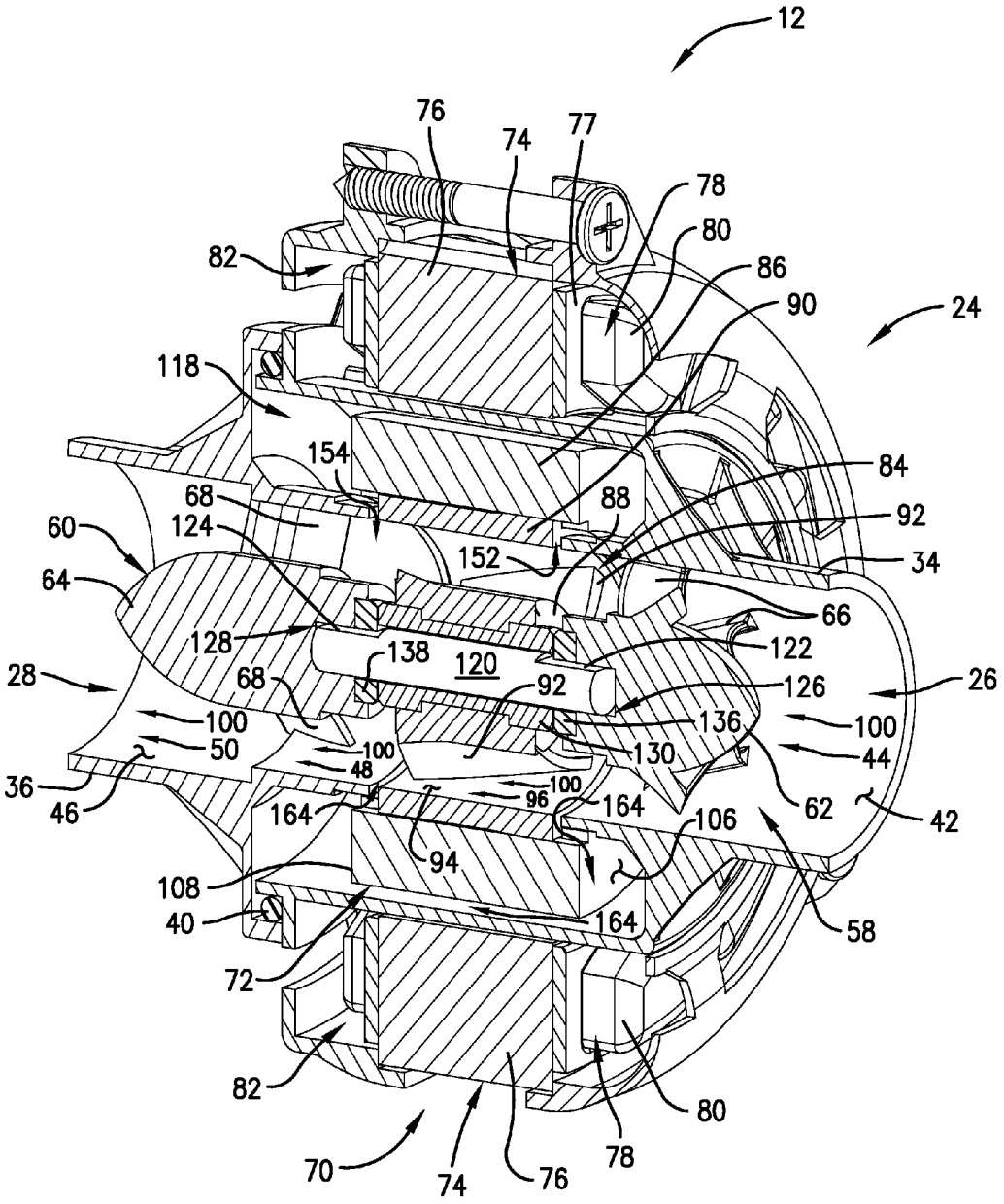
FIG. 4 is a front perspective sectional view of the electric pump of FIGS. 2 and 3, particularly illustrating the mounting of the motor and its positioning relative to the flow path.
Figure 4A:
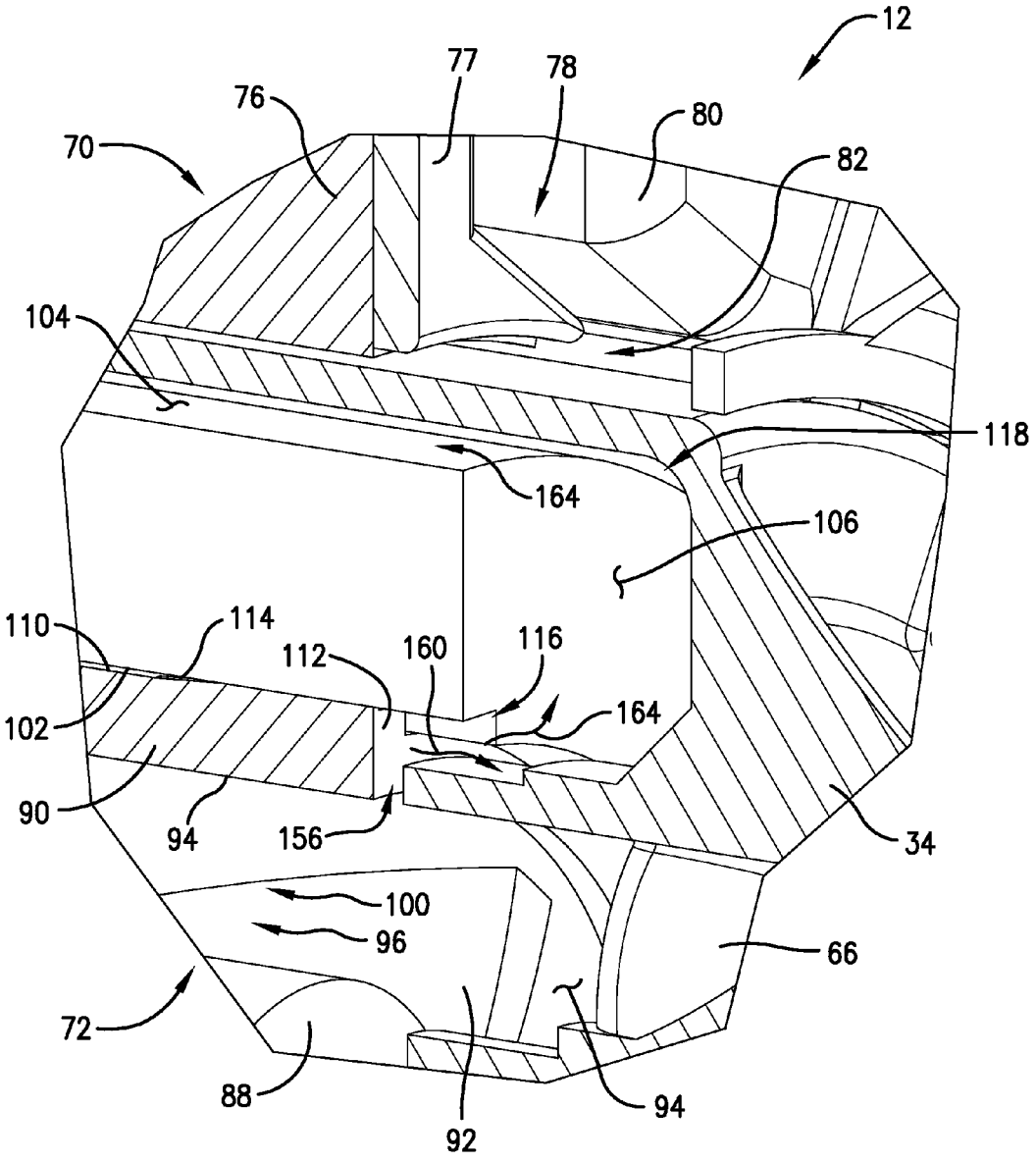
Figure 5:
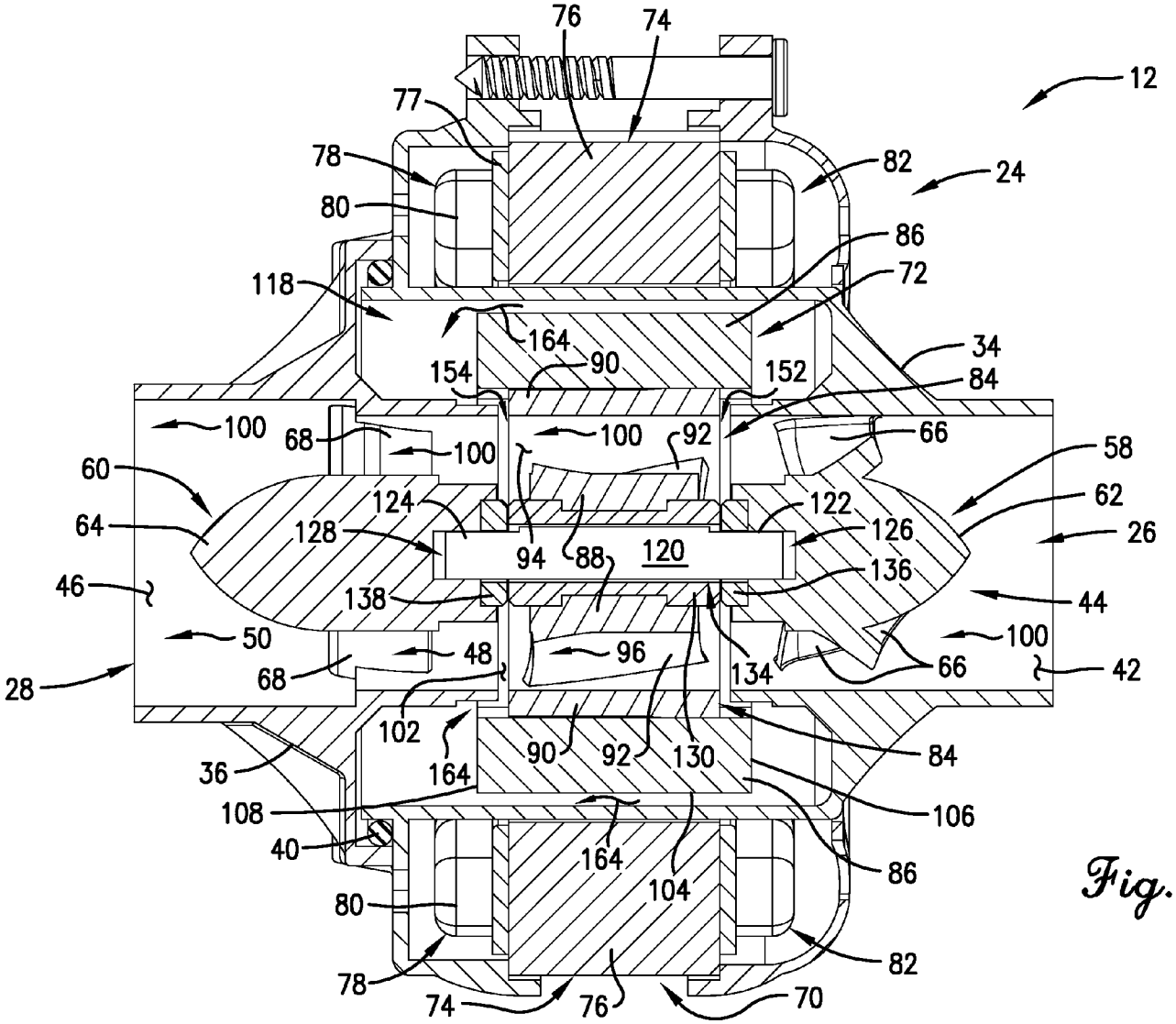

FIG. 4*a* is an enlarged fractional front perspective view of a portion of the electric pump of FIGS. 2-4 as shown in FIG. 4, particularly illustrating the secondary flow path defined by the pump housing and the rotor;

FIG. 5 is a cross-sectional view of the electric pump of FIGS. 2-4.

Figure 5A:
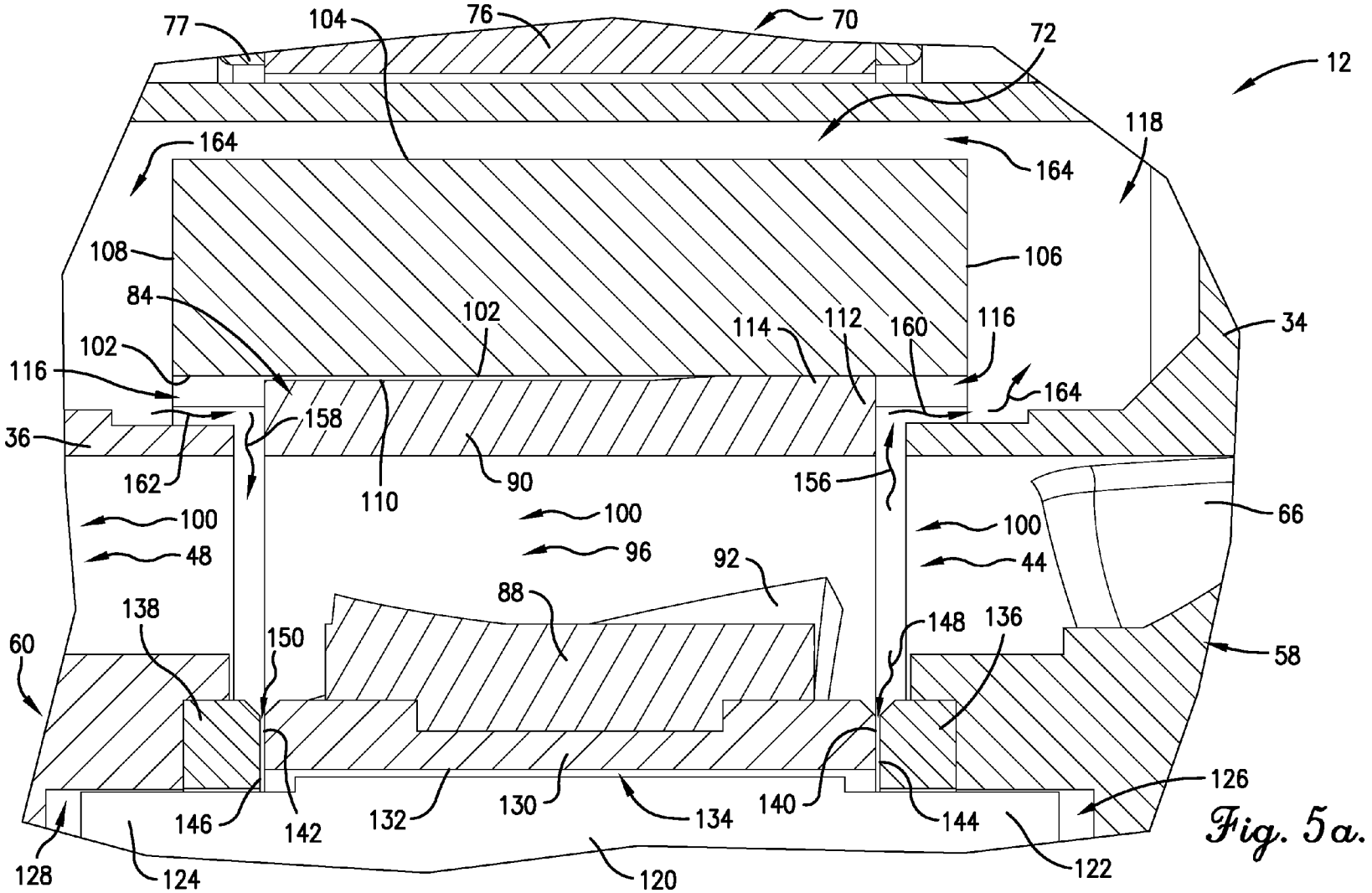
Figure 6:
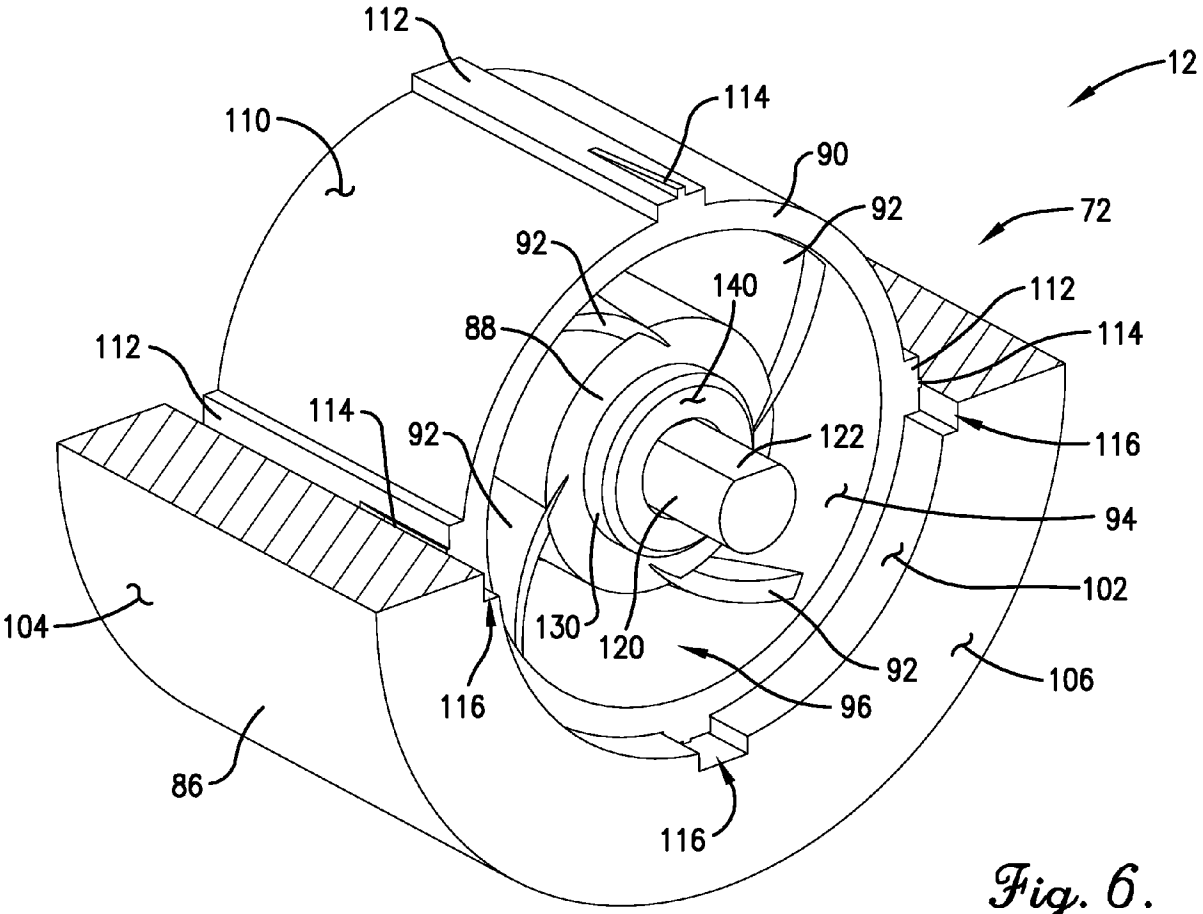
Figure 7:
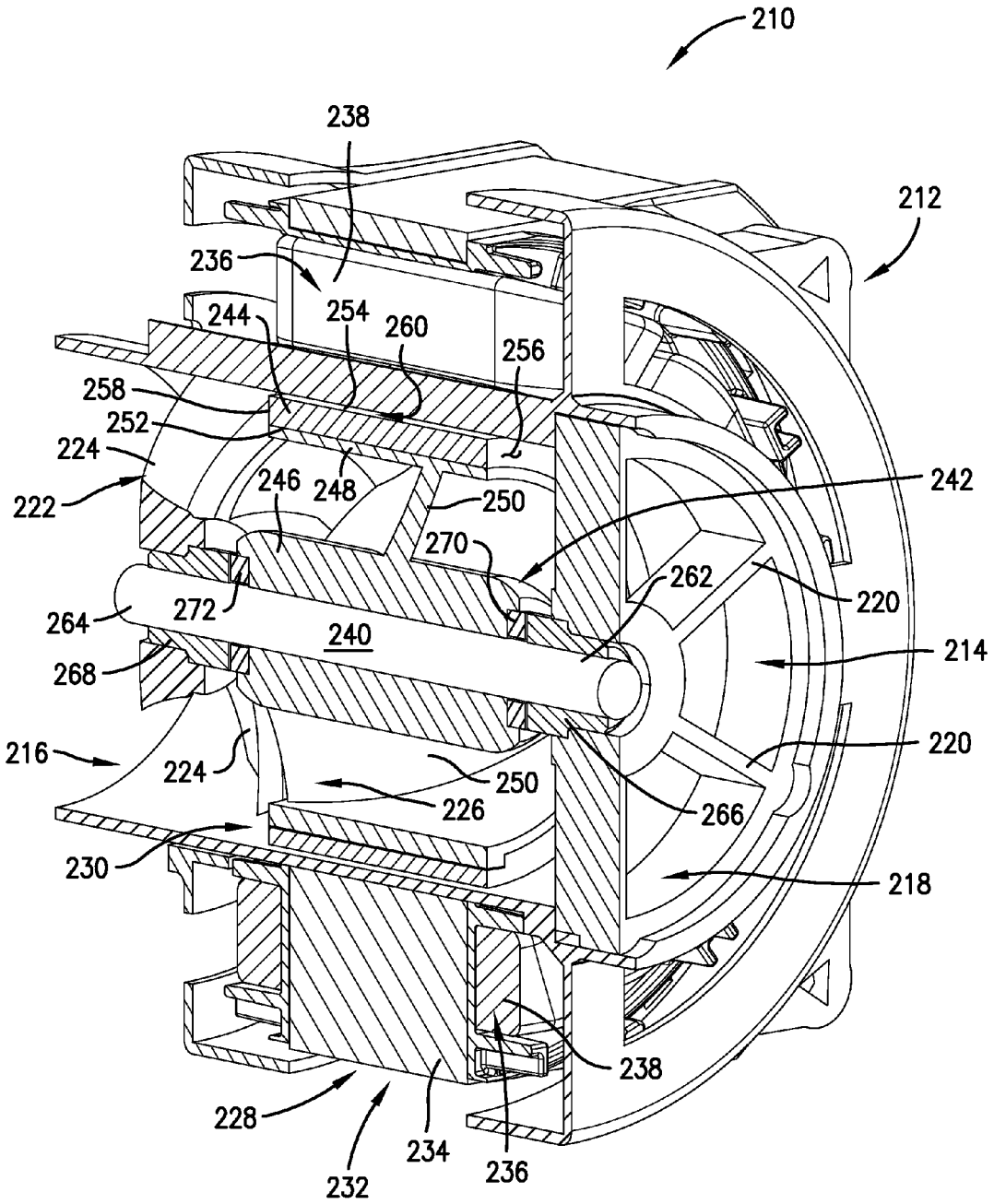
Figure 8:
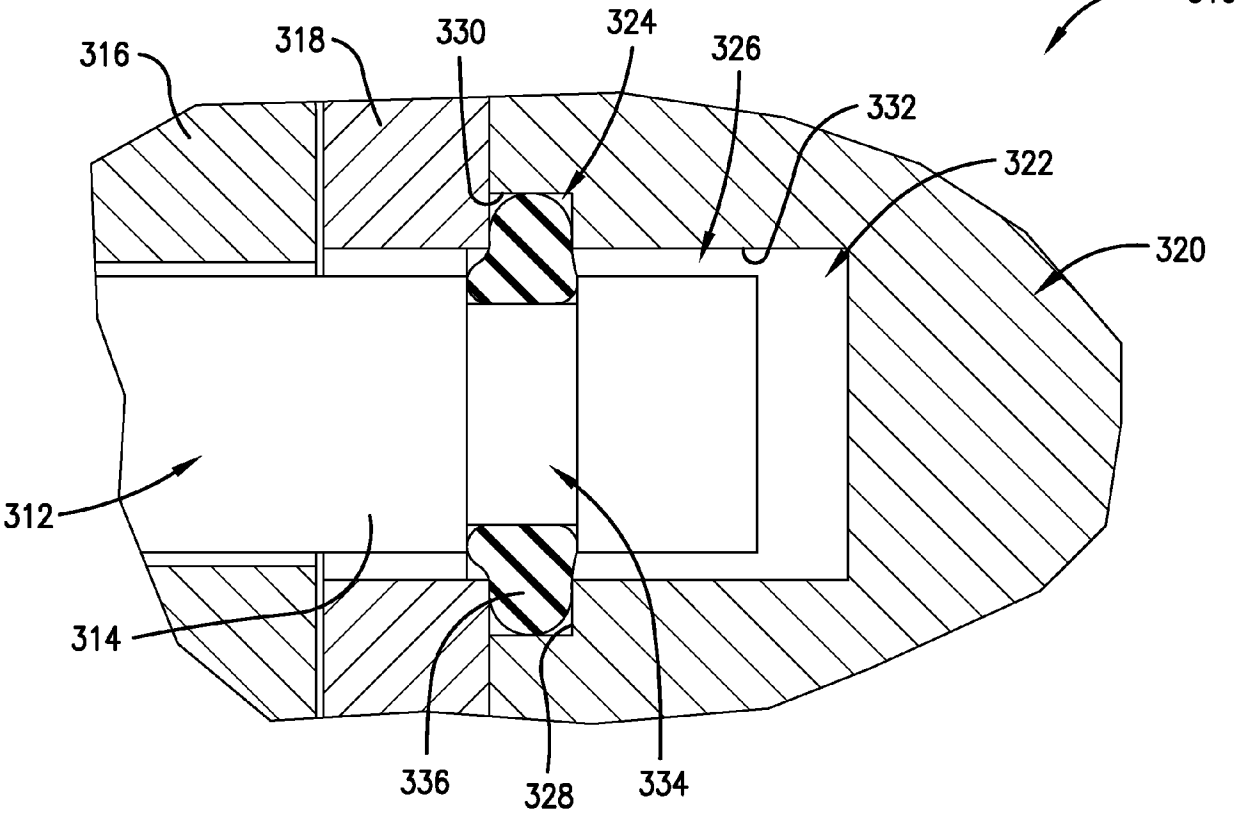

FIG. 5*a* is an enlarged fractional cross-sectional view of a portion of the electric pump of FIGS. 2-5 as shown in FIG. 5, particularly illustrating the secondary flow path defined by the pump housing and the rotor and the lubrication pathway formed between the shaft and the sleeve bearing;

FIG. 6 is a partially sectioned front perspective view of a portion of the electric pump of FIGS. 2-5, particularly illustrating the three-dimensional structure of the impeller and of the secondary flow path defined by the pump housing (not shown) and the rotor;

FIG. 7 is a front sectional perspective view of an electric pump constructed in accordance with the principles of a second embodiment of the present invention; and FIG. 8 is an enlarged fractional cross-sectional view of a portion of an electric pump constructed in accordance with the principles of a third embodiment of the present invention.

The drawing figures do not limit the present invention to the specific embodiments disclosed and described herein. The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
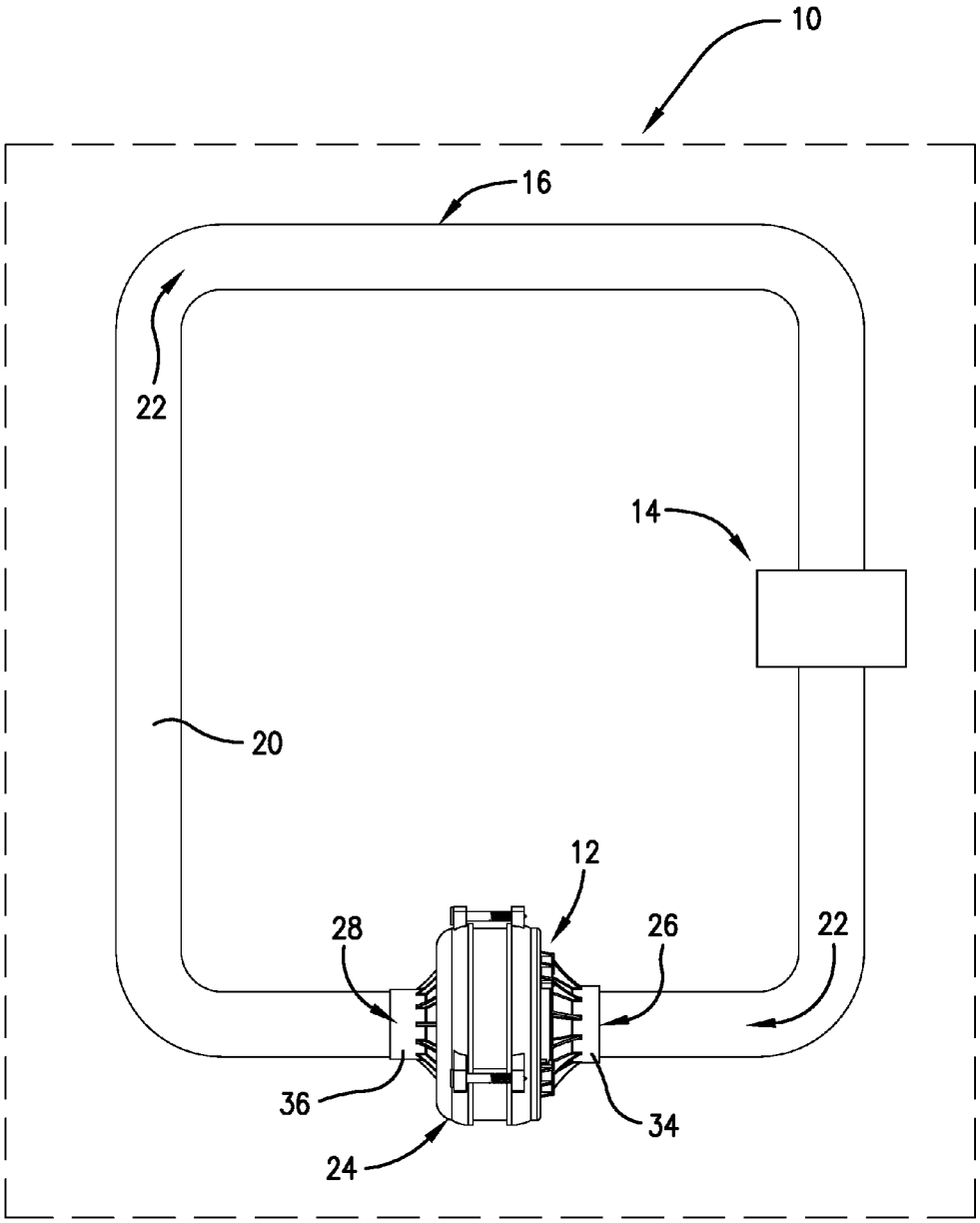
FIG. 1 is a schematic view of an appliance constructed in accordance with the principles of the present invention.

With initial reference to FIG. 1, an appliance 10 is depicted. The appliance 10 preferably includes an electric pump assembly 12 and a fluid-influencing mechanism 14. The appliance 10 also preferably includes a line 16 including an inlet portion 18 that extends from the fluid-influencing mechanism 14 to the pump assembly 12 and an outlet portion 20 that extends from the pump assembly 12 to the fluid-influencing mechanism 14, such that closed loop for recirculating fluid flow is formed. The line 16 preferably defines a fluid passageway 22.

The appliance 10 may suitably be any one of a number of appliances, including but not limited to dishwashers; hot tubs; spas; water heaters; heating and air conditioning systems; and radiant heating systems for floors, sidewalks, or driveways. The fluid-influencing mechanism 14 may suitably be any one or more of a number of structures operable to influence or act upon a fluid via agitation, pressurization, heating, or any other mechanism known in the art.

It should also be understood that the appliance 10 may vary from that schematically illustrated in FIG. 1 without departing from the scope of the present invention. For instance, the piping system might vary from the solitary closed-loop arrangement illustrated therein (e.g., through inclusion of auxiliary lines or presentation in a non-closed form), or the fluid-influencing mechanism 14 might be replaced by or provided in addition to another component or components suited to the particular appliance. A condenser or a heat sink might be provided, for instance, or a valve could be added. Ultimately, any appliance configuration known in the art is permissible, contingent on the appliance including a pump assembly in accordance with the present invention. Suitable pump assemblies are described in detail below with reference to first, second, and third preferred embodiments.

Turning to FIGS. 2 and 3, an electric pump assembly 12 constructed in accordance with a first preferred embodiment of the present invention is depicted for use in an appliance 10. The pump assembly 12 is encased in a housing 24 defining an inlet opening 26 and an outlet opening 28. (For the sake of convenience, terms such as "inlet" and "outlet" are used herein. However, it is to be understood that a fluid might flow in an opposite direction such that a component described herein as pertaining to an "inlet" might in fact relate to an "outlet," and vice versa.)

The housing 24 is preferably formed of plastic, although the housing 24 may alternatively be formed of any one or more of a variety of materials without departing from the scope of the present invention.

The inlet opening 26 and the outlet opening 28 are preferably circular in cross-section, although non-circular inlet and/or outlet openings may be provided without departing from the scope of the present invention.

Preferably, the housing 24 comprises multiple portions to allow for ease of assembly of the pump assembly 12 and ease of access to internal components of the pump assembly 12 for maintenance, repair, or replacement. In a preferred embodiment, such portions include an inlet-defining portion 34 and an outlet-defining portion 36 sealed relative to each other by an O-ring 40 (FIGS. 4 and 5). It is permissible, however, for the housing to comprise more or fewer portions and for the portions, if multiple, to be connected by any means known in the art, including but not limited to adhesives, latches, and tongue-and-groove connections. Furthermore, any means known in the art may be used to seal the interface between the housing portions, if multiple portions are provided.

Preferably, the inlet-defining portion 34 defines the inlet opening 26, and the outlet-defining portion 36 defines the outlet opening 28. Even further, it is preferable that the inlet-defining portion 34 includes an inner surface 42 that defines an inlet passageway 44 and that the outlet-defining portion 36 includes an inner surface 46 that defines proximal and distal outlet passageways 48 and 50, respectively. It is permissible, however, for a single outlet passageway to be provided.

Preferably, the cross-sectional dimensions of the inlet passageway 44 and the proximal and distal outlet passageways 48 and 50 are at least substantially invariant along the axes of the respective passageways 44, 48, and 50, as best shown in FIGS. 4 and 5. It is permissible, however for axially varying cross-sectional dimensions to be provided. Furthermore, such cross-sectional dimensions are preferably diameters, although non-circular inlet and/or outlet passageways may be provided without departing from the scope of the present invention.

Preferably, the inlet opening cross-sectional dimension is equal to the inlet passageway cross-sectional dimension. Similarly, the outlet opening cross-sectional dimension is preferably equal to the distal outlet passageway cross-sectional dimension. In addition, it is preferable that the inlet opening cross-sectional dimension, the inlet passageway cross-sectional dimension, and the proximal outlet passageway cross-sectional dimension are all equal, with the distal outlet passageway cross-sectional dimension (and the outlet opening cross-sectional dimension) being larger. Such dimensional relationships may be modified without departing from the scope of the present invention, however.

Preferably, a stationary inlet flow guide 58 is provided in the inlet passageway 44, and a stationary outlet flow guide 60 is located in the outlet passageways 48 and 50. The flow guides 58 and 60 preferably include respective diverter cones 62 and 64. Furthermore, each of the flow guides 58 and 60 preferably includes a respective plurality of stationary vanes 66 and 68. However, it should be understood that use of any one or more of variety of flow guide configurations, including use of no flow guides, falls within the scope of the present invention.

As shown in FIG. 1, in a preferred embodiment, the inlet portion 18 of the line 16 is connected to the pump assembly 12 adjacent the inlet opening 26, and the outlet portion 20 of the line 16 is connected to the pump assembly 12 adjacent the outlet opening 28. Each of said inlet portion 18 and said outlet portion 20 includes a respective straight portion adjacent the respective inlet or outlet opening 26 or 28. The straight portions are preferably axially aligned with the openings 26 and 28 such that no change in flow direction is necessary in the immediate vicinity of the pump assembly 12.

The line 16 may suitably be connected adjacent the inlet opening 26 and the outlet opening 28 by any means known in the art, including but not limited to threaded, grooved, push-type, glued, flanged, or flexible fittings.

As shown in FIG. 4 and others, the pump assembly 12 preferably includes a motor 70 comprising a rotor 72 and a stator 74. In a preferred embodiment, as illustrated, the stator 74 at least substantially circumscribes the rotor 72, although it is within the ambit of the present invention for an outer rotor configuration to be utilized.

The stator 74 preferably includes a generally toroidal core 76, a cover 77 disposed about the core 76, and a plurality of coils 78 comprising wire 80 wound about the core 76.

The core 76 preferably comprises a ferromagnetic material such as steel and is preferably laminated. However, it is within the ambit of the present invention for the core to comprise an alternative material and be of an alternative structure. For instance, the core might be integrally formed, be composed of iron, or feature a combination of these or other variations known to one skilled in the art. The core could also comprise a plurality of discrete segments or deviate from the preferred toroidal form without departing from the spirit of the present invention.

The cover 77 is shown schematically to generally represent that the stator core is insulated. That is, the cover 77 as illustrated simply exemplifies that the stator core is preferably insulated in some manner, including but not limited to use of tabs, powder-coating, or other approaches as appropriate to the particular application.

The wire 80 is preferably copper wire, although aluminum wire or other electrically conductive wire may be used without departing from the scope of the present invention.

The housing 24 preferably defines a stator chamber 82. The stator 74 is preferably received within the stator chamber 82.

The rotor 72 preferably includes an impeller 84 and a magnet 86. The impeller 84 preferably includes a hub 88, a rim 90, and a plurality of blades 92 extending between the hub 88 and the rim 90. As is customary, the blades are preferably shaped and pitched to most efficiently cause fluid movement when the impeller is rotated.

Preferably, the rim 90 and the hub 88 are at least substantially annular in form and extend continuously circumferentially. However, it is permissible for voids to be formed in either or both of the hub and the rim.

The impeller may alternatively include a single blade. For instance, a single helical blade might alternatively be provided.

Preferably, the rim 90 circumscribes the hub 88, with the blades 92 connecting the rim 90 to the hub 88. However, it is permissible for the rim and the hub to be interconnected by means other than or in addition to the blades. For instance, blades might be provided that extend from the hub but do not engage the rim, with struts, rods, magnets, or other structure being provided for physical connection or non-contacting relative constraint purposes.

As best shown in FIGS. 4 and 5, the rim 90 preferably includes an inner surface 94 defining an intermediate passageway 96. Preferably, the cross-sectional dimension of the intermediate passageway 96 is at least substantially invariant along the axis of the rim 90, although variations may be present without departing from the spirit of the present invention.

Furthermore, it is preferable that the cross-sectional dimension of the intermediate passageway 96 is equal to the cross-sectional dimensions of the inlet passageway 44 and the proximal outlet passageway 48. Even further, it is preferable that the axes of such passages 44, 48, and 96 are in alignment such that the passages 44, 48, and 96 form a primary, generally linear flow path 100 of the pump assembly 12.

It is additionally preferable that the axis of the distal outlet passageway 50 is also coaxial with the above-mentioned axes, such that the distal outlet passageway 50 also cooperatively defines the primary flow path 100. In such a preferred embodiment, the primary flow path 100 would have an invariant cross-sectional diameter except in the distal outlet passageway 50, in which the flow path enlarges.

It should be understood that a variety of deviations from the illustrated embodiment, whether in terms of dimensions, number of passages, or some other parameter, may be implemented without departing from the scope of the present invention.

As noted previously, the rotor 72 preferably includes an impeller 84 and a magnet 86. The magnet 86 is preferably a permanent magnet at least substantially annular in form and extending continuously circumferentially. It is permissible, however, for the magnet 86 to include voids or to comprise multiple magnet pieces. Shape variations are also permissible.

The magnet 86 preferably defines a radially inner surface 102, a radially outer surface 104, and a pair of radially extending axially spaced apart end surfaces 106 and 108.

The magnet 86 preferably circumscribes and abuts the rim 90 of the impeller 84. However, it is permissible in alternative embodiments for the magnet to be smaller in radial dimension than the rim or even than the hub. In the latter case, positioning of the stator radially inside the magnet (i.e., use of an outer rotor configuration) is likely preferable.

As best shown in FIG. 6, the rim 90 preferably defines a radially outer surface 110 from which a plurality of circumferentially spaced apart ribs 112 project. A compressible shim 114 is provided on each rib 112. The magnet 86 preferably includes a plurality of circumferentially spaced apart grooves 116 corresponding to the ribs 112. In the assembled state, the ribs 112 are received within the grooves 116, with the shims 114 being compressed between the magnet 86 and the rim 90. Furthermore, the inner surface 102 of the magnet 86 is preferably maintained in close proximity to (see, for instance, FIG. 5*a*) or in abutment with the outer surface 110 of the rim 90.

The ribs 112 and grooves 116 cooperatively ensure that the impeller 84 and the magnet 86 are rotationally fixed to one another. However, although the above-described arrangement is preferred, it should be understood that any one or more of a variety of connection or fixation means known in the art are permissible for rotationally securing the impeller and the magnet to each other. For instance, adhesives, post-and-hole, or friction-based arrangements might be used; or the magnet might be encased by the impeller or by another structure. Even further, the impeller and the magnet might alternatively both be molded of the same material so as to be integral with and inseparable from each other.

As best shown in FIGS. 4 and 5, the housing 24 preferably defines a magnet chamber 118. The magnet 86 is preferably at least substantially housed within the magnet chamber 118 such that the magnet 86 is remote from and circumscribes the primary flow path 100, as will be discussed in greater detail below.

As shown in FIGS. 4, 5, and others, the rotor 72 preferably includes a stationary shaft 120. The shaft 120 preferably includes a pair of keyed regions 122 and 124 that interact with respective slots 126 and 128 formed in the inlet flow guide 58 and the outlet flow guide 60, respectively, so that rotation of the shaft 120 is prohibited. However, any one or more of a variety of shaft fixation means might be used to prevent its rotation, as described further below.

A sleeve bearing 130 preferably circumscribes the shaft 120 and, as best shown in FIG. 5*a*, includes a radial bearing surface 132. A gap 134 is formed between the shaft 120 and the radial bearing surface 132 and is operable to receive a fluid for lubrication of the sleeve bearing 130. Because the fluid is used as a lubricant in the illustrated embodiment, the pump 12 is particularly suitable for use with liquids.

The bearing 130 may be formed by any suitable technique, although it is particularly desirable to overmold the bearing 130 in place within the hub 88 and then machine the inside diameter of the bearing 130 as necessary.

Preferably, the sleeve bearing 130 comprises a single, integral piece. However, the bearing may be split into two or more segments without departing from the scope of the present invention.

In a preferred embodiment, the hub 88 of the impeller 84 circumscribes and is attached to the bearing 130 such that the impeller 84 is rotatable with the bearing 130. Thus, the bearing 130, the impeller 84, and the magnet 86 are rotatable in unison relative to the stator 74, the shaft 120, and the housing 24 (including the inlet and outlet flow guides 58 and 60). As will be discussed in more detail below, however, it is within the scope of the present invention for at least some of the rotating components of the preferred embodiment described above to be fixed and for at least some of the stationary components of the preferred embodiment described above to be rotatable. For instance, an alternative bearing arrangement might be used which utilizes a stationary bearing or bearings in combination with a rotating shaft.

The pump assembly 12 also preferably includes a pair of thrust washers 136 and 138. The thrust washers 136 and 138 are axially spaced apart so as to slidingly engage or nearly abut the ends of the sleeve bearing 130. More particularly, as shown in FIG. 5*a* and others, the sleeve bearing 130 includes a pair of axially spaced apart axial bearing surfaces 140 and 142 for engagement with corresponding thrust surfaces 144 and 146 on respective ones of the thrust washers 136 and 138. Preferably, respective gaps 148 and 150 are formed between the axial bearing surfaces 140 and 142 and the corresponding thrust surfaces 144 and 146 to allow for flow of a lubricating fluid therebetween.

Although it is preferable for the thrust surfaces to be provided by thrust washers, the thrust surfaces may be defined by any suitable component of the pump assembly without departing from the scope of the present invention. For instance, a suitable pair of thrust surfaces might be formed on or integrally with the housing itself.

In another permissible alternative, a thrust surface or surfaces might be formed on the shaft. For example, the shaft might include a smaller outer diameter region adjacent and abutting a larger outer diameter region such that a radially extending shoulder or thrust surface is defined at the junction of the larger outer diameter region and the smaller outer diameter region. In such an alternative configuration, the sleeve bearing would preferably be modified to include a smaller inner diameter region corresponding to the smaller outer diameter region of the shaft, as well as a larger inner diameter region corresponding to the larger outer diameter region of the shaft. The smaller and larger inner diameter regions of the bearing are preferably adjacent and abutting each other so that a radially extending shoulder or bearing surface is defined at the junction of the smaller inner diameter region adjacent and the larger inner diameter region. The bearing surface of the sleeve bearing would thus correspond to the thrust surface of the shaft.

In the above alternative embodiment, it is likely preferable for ease of assembly and/or cost-effectiveness to provide only one set of corresponding thrust and bearing surfaces. However, it is within the scope of the present invention for two or more thrust surfaces corresponding to two or more bearing surfaces to be provided.

In a preferred embodiment, as discussed above, the magnet 86 is at least substantially housed in the magnet chamber 118 spaced radially outwardly from the primary flow path 100. The chamber 118 is preferably fluidly interconnected with the primary flow path 100 by a pair of restricted flow conduits 152 and 154. Each of said flow conduits 152 and 154 preferably includes substantially orthogonal sections, such that a fluid therein is prevented from flowing linearly from the primary flow path 100 to the magnet chamber 118 or from the magnet chamber 118 to the primary flow path 100.

More particularly, as best shown in FIG. 5*a*, each of the flow conduits 152 and 154 preferably includes a respective first conduit section 156 or 158 extending generally radially outwardly from the primary flow path 100 and a respective second conduit section 160 or 162 extending from the corresponding first conduit section 156 or 158 in a generally axial direction.

Preferably, the second conduit sections 160 and 162 extend in at least substantially opposite generally axial directions relative to the directions of extension of the corresponding first sections 156 and 158.

Preferably, each of the first and second conduit sections 156, 158, 160, and 162 is cooperatively defined by the housing 24 and the rotor 72. More particularly, the first conduit sections 156 and 158 are preferably at least in part cooperatively defined by the housing 24 and the rim 90 of the impeller 84; and the second conduit sections 160 and 162 are preferably at least in part cooperatively defined by the housing 24 and the magnet 86.

Preferably, the flow conduit 152, the chamber 118, and the flow conduit 154 cooperatively define a secondary flow path 164. More particularly, the secondary flow path 164 may more accurately be described as being defined cooperatively by the flow conduit 152, the portion of the chamber 118 not filled by the magnet 86, and the flow conduit 154.

The configuration of the secondary flow path 164 is preferably such that a fluid flowing therethrough will be slowed relative to that of a similar or identical fluid flowing through the primary flow path 100. The fluid in the secondary flow path 164 is preferably thereby operable to provide cooling of the rotor 72 and the stator 74. Preferably, the fluid is further operable to lubricate the interface between the rotor 72 and the housing 24. Most preferably, the fluid is operable to lubricate the interface between the rotor 72 and the housing 24 in a region adjacent the stator 74. Again, the illustrated embodiment is most suitable for use with a liquid. However, use of a liquid is not required.

It is also preferable that the configuration of the secondary flow path 164 is such that debris is restricted from entering the magnet chamber 118. Such functionality will preferably lead to decreased clogging of the rotor 72 and, in turn, decreased maintenance requirements. Furthermore, by not having a significant portion of fluid flowing through the magnet chamber 118, inefficiencies associated with diverting flow, turbulence, etc. are reduced.

Although the orthogonally arranged sections described above illustrated a preferred embodiment, it is to be understood that other orthogonal arrangements, in which the flow bends or changes direction at least once along a substantially transverse path, fall within the scope of the present invention. For instance, the sections might be straight and arranged at acute or obtuse angles, or the sections might be curved (e.g., C-shaped or S-shaped sections). Additional sections might be provided, as well. Ultimately, any one of a variety of tortuous, twisting, zig-zag, labyrinthine, or otherwise indirect configurations may be permissible.

As best shown in FIG. 6, the flow conduits 152 and 154 preferably extend around the entire circumference of the housing 24 and the rotor 72, such that the cooling and debris-blocking advantages described above are maximally applied. However, it is permissible within the scope of the present invention for the flow conduits 152 and 154 to be circumferentially discontinuous. In such a case, a single flow conduit might be provided, or one flow conduit might be provided on each axial side. In yet another alternative, a plurality of circumferentially spaced conduits might be provided on one or both axial sides. Other variations fall within the scope of the present invention, as well.

In operation of the first preferred embodiment as described above, a fluid flows from the fluid-influencing mechanism 14, through the inlet portion 18 of the line 16, and into the inlet opening 26 of the pump assembly 12. The fluid is then drawn through the inlet passageway 44 and is directed by the inlet flow guide 58 into the intermediate passageway 96 that passes through the rotor 72. The impeller 84, as it rotates about the stationary shaft 120 on the sleeve bearing 130, drives the flow.

Preferably, a first auxiliary portion of the fluid flows into the gaps 134, 148, and 150 so as to lubricate and cool the bearing 130.

Furthermore, a second auxiliary portion of the fluid is preferably diverted into the secondary flow path 164. More particularly, a second auxiliary portion of the fluid is preferably diverted into the flow conduit 152 and, in turn, into the magnet chamber 118. The fluid will preferably move slowly through the chamber 118 before exiting through the flow conduit 154 to rejoin the fluid in the primary flow path 100. It is permissible, however, for some or all of the fluid that enters the chamber 118 via the flow conduit 152 to remain in the chamber 118 during operation of the pump assembly 12 or even after the operation of the pump assembly 12 is complete. In essence, fluid is diverted to fill the chamber 118 but not necessarily flow through it at the same rate as fluid flowing along the primary flow path 100.

Any fluid continuing to flow through the intermediate passageway 96 (i.e., rather than being diverted for bearing 130 lubrication or into the secondary flow path 164) is preferably directed by the outlet flow guide 60 into and through the proximal and distal outlet passageways 48 and 50, respectively. The fluid then flows through the outlet portion 20 of the line 16 to the fluid-influencing mechanism 14, and the cycle repeats.

Rotation of the rotor 72, its interactions with the stator 74, and the energized stator 74 itself produce heat which is advantageously dissipated by the appropriate utilization of fluid flowing through the pump assembly 12, as described above.

Rotation of the rotor 72 also results in axial loading of the rotor in a direction dependent on its direction of rotation. That is, rotation in a counter-clockwise direction will lead to axial loading in a first direction, while rotation in a clockwise direction will lead to axial loading in a second axial direction, opposite the first axial direction. Provision of a sleeve bearing 130 having axial bearing surfaces 140 and 142, as well as thrust washers 136 and 138 having thrust surfaces 144 and 146, accommodates such axial loading regardless of which direction of rotation is used. That is, it is permissible for the rotor 72 rotation direction to be reversed, thus reversing the direction of the flow (such that the outlet opening 28 acts as an inlet, the inlet opening 26 acts as an outlet, etc.), without the loss of load-resolving abilities. However, although a bi-directional pump assembly 12 with dual thrust washers 136 and 138 and axial bearing surface 140 and 142 on the sleeve bearing 130 is preferred, it is within the scope of the present invention for the rotor to be rotatable in a single direction only and for a single thrust washer and axial bearing surface to be provided.

In addition to the load and heat dispersion advantages described above, the pump assembly 12 constructed in accordance with the preferred embodiment described above also reduces flow losses and increases hydraulic efficiency and well as motor efficiency. The pump is operable at high speeds and, due to its in-line configuration, is suitable for placement in appliances in which space constraints are a concern. Even further, the simplicity of the design leads to lower manufacturing and assembly costs.

With reference to FIG. 7, an electric pump assembly 210 constructed in accordance with a second preferred embodiment of the present invention is depicted for use in the appliance 10 shown in FIG. 1. It is initially noted that, with certain exceptions to be discussed in detail below, many of the elements of the pump assembly 210 of the second embodiment are the same as or very similar to those described in detail above in relation to the pump assembly 12 of the first embodiment. Therefore, for the sake of brevity and clarity, redundant descriptions and numbering will be generally avoided here. Unless otherwise specified, the detailed descriptions of the elements presented above with respect to the first embodiment should therefore be understood to apply at least generally to the second embodiment, as well.

The pump assembly 210 preferably includes a housing 212 defining an inlet opening 214 and an outlet opening 216. A stationary inlet flow guide 218 including a plurality of vanes 220 is preferably positioned in or adjacent the inlet opening 214, and a stationary outlet flow guide 222 including a plurality of vanes 224 is preferably positioned in or near the outlet opening 216. The housing 212 and the inlet flow guide 218 cooperatively define a primary flow path 226 through the pump assembly 210.

The pump assembly 210 preferably includes a motor 228 comprising a rotor 230 and a stator 232. The stator 232 preferably includes a generally toroidal core 234 and a plurality of coils 236 comprising wire 238 wound about the core 234.

The rotor 230 preferably includes a rotatable shaft 240, an impeller 242, and a magnet 244. The impeller 242 preferably includes a hub 246, a rim 248 that circumscribes the hub 246, and a plurality of blades 250 extending between and interconnecting the hub 246 and the rim 248. The magnet 244 is preferably annular in form and circumscribes the rim 248. Furthermore, the magnet 244 is preferably fixed to the rim 248 such that the impeller 242 and the magnet 244 rotate in unison.

The magnet 244 preferably defines a radially inner surface 252, a radially outer surface 254, and a pair of radially extending, axially spaced apart end surfaces 256 and 258. The magnet 244 is preferably positioned within the primary flow path 226 such that a fluid flowing therethrough would be obstructed by the magnet 244. More particularly, a fluid flowing from the inlet opening 214 through the primary flow path 226 would be obstructed by the end surface 256.

Preferably, a circumferential gap 260 is formed between the outer surface 254 of the magnet and the housing 212 such that a lubricating fluid may flow into the gap 260 to provide lubrication and cooling.

In a preferred embodiment, the shaft 240 includes first and second ends 262 and 264, respectively. The ends 262 and 264 are rotatably supported by respective bearing systems 266 and 268 that are mounted on the inlet flow guide 218 and the outlet flow guide 222, respectively.

A pair of thrust washers 270 and 272 is provided, as well. Preferably, the thrust washers 270 and 272 are fixed to axially opposite ends of the impeller 242 to rotate therewith.

The impeller 242 is fixed to the shaft 240 by any suitable means known in the art such that the shaft 240, the impeller 242, the thrust washers 270 and 272, and the magnet 244 rotate in unison.

In operation of the second preferred embodiment as described above, a fluid flows from a fluid-influencing mechanism (not shown) to the pump assembly 210 in a similar manner to that described above with reference to the first preferred embodiment. However, rather than flowing though a labyrinthine secondary flow path to provide cooling of the rotor 230 and the stator 232, incoming fluid impacts the end surface face 256 of the magnet 244 and flows into the gap 260 between the magnet 244 and the housing 212.

Also in contrast to the operation of the first preferred embodiment, the shaft 240 of the second preferred embodiment is rotatable and is supported by bearing systems 266 and 268 at the shaft ends 262 and 264, respectively.

With reference to FIG. 8, a portion of an electric pump assembly 310 constructed in accordance with a third preferred embodiment of the present invention is depicted for use in the appliance 10 shown in FIG. 1. It is initially noted that, with certain exceptions to be discussed in detail below, many of the elements of the pump assembly 310 of the third embodiment are the same as or very similar to those described in detail above in relation to the pump assembly 12 of the first embodiment. Therefore, for the sake of brevity and clarity, redundant descriptions and numbering will be generally avoided here. Unless otherwise specified, the detailed descriptions of the elements presented above with respect to the first embodiment should therefore be understood to apply at least generally to the third embodiment, as well.

The pump assembly 310 preferably includes a shaft 312 having an end 314, a sleeve bearing 316 that preferably circumscribes the shaft 312 and is rotatable relative thereto, and a thrust washer 318 that also preferably circumscribes the shaft 312. The thrust washer 318 is preferably positioned axially adjacent the sleeve bearing 316 so as to slidably engage or nearly abut the sleeve bearing 316.

The pump assembly 310 also preferably includes an inlet flow guide 320 that defines a slot 322 having a proximal region 324 and a distal region 326. The distal region 326 is preferably constricted relative to the proximal region 324, such that a shoulder 328 is formed at the transition between the regions 324 and 326. The proximal and distal regions define inner surfaces 330 and 332, respectively. The end 314 of the shaft 312 preferably extends into and is received within the slot 322.

A groove 334 is preferably formed in the end 314 of the shaft 312. The groove 334 is preferably circumferentially continuous, although it is within the scope of the present invention for the groove to be non-continuous or to be non-circumferential.

In a preferred embodiment, the pump assembly 310 also includes an O-ring. The O-ring 336 is preferably positioned in the groove 334 so as to circumscribe the shaft 312. The O-ring 336, the shaft 312, the groove 334, the proximal region 324 of the slot 322, and the thrust washer 318 are preferably sized and positioned relative to one another such that the O-ring 336 contacts and is placed in compression by the shaft 312, the shoulder 328, the inner surface 330 of the proximal region 324 of the slot 322, and the thrust washer 318. The O-ring is thus operable due to frictional forces to restrict or at least substantially prevent rotation of the shaft 312 relative to the stationary components of the pump assembly 310.

The O-ring is preferably circular, elliptical, oval, or otherwise regular in cross-section and toroidal in shape but is shown in a compressed condition in FIG. 8. However, it is within the scope of the present invention for an O-ring having an irregular cross-section or overall shape to be provided.

Although the above description presents features of preferred embodiments of the present invention, other preferred embodiments may also be created in keeping with the principles of the invention. Furthermore, as noted previously, these other preferred embodiments may in some instances be realized through a combination of features compatible for use together despite having been presented independently as part of separate embodiments in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. An appliance comprising:

a fluid line presenting a fluid passageway;

a mechanism coupled to the line so as to be operable to act on fluid within the passageway; and an axial flow pump operable to move fluid along the passageway, said pump including— a housing coupled to the fluid line, with the housing at least in part defining a primary flow path therethrough that is fluidly connected to the passageway, and a motor including a rotor and a stator, said rotor including an impeller and a magnet, said impeller including a blade disposed in the primary flow path, said housing at least in part defining a fluid chamber spaced radially outward from the primary flow path, said chamber being fluidly interconnected with the primary flow path by a first restricted flow conduit and a second restricted flow conduit, each of said flow conduits including substantially orthogonal sections, with a first conduit section extending generally radially outward from the primary flow path and a second conduit section extending between the first section and the chamber in a generally axial direction, such that fluid is prevented from flowing linearly between the primary flow path and the chamber, said pump configured such that fluid flows sequentially from the primary flow path, through the first flow conduit, and into the chamber, said magnet being located generally within the chamber.

2. The appliance as claimed in claim 1, said flow conduits and said chamber cooperatively defining a secondary flow path.

3. The appliance as claimed in claim 2, said secondary flow path being configured to slow fluid flow therethrough relative to fluid flow through the primary flow path.

4. The appliance as claimed in claim 3, said magnet being disposed in the secondary flow path.

5. The appliance as claimed in claim 1,
said impeller including a substantially annular hub and a substantially annular rim that is spaced radially from the hub and supports the magnet,
said blade extending between and interconnecting said hub and said rim.
6. The appliance as claimed in claim 1,
said impeller including a plurality of blades.
7. The appliance as claimed in claim 1,
said rotor further including a stationary shaft and a sleeve bearing rotatably supported on the shaft, wherein said impeller is fixed to the sleeve bearing for rotational movement therewith.
8. The appliance as claimed in claim 7,
said pump including a stationary bearing surface facing a first generally axial direction,
said sleeve bearing including an axial bearing face engaging the stationary bearing surface so as to permit rotational movement of the sleeve bearing relative to the stationary bearing surface while restricting relative axial movement of the sleeve bearing.
9. The appliance as claimed in claim claim 8,
said pump including a second stationary bearing surface facing a second generally axial direction that is at least substantially opposite the first generally axial direction,
said sleeve bearing including a second axial bearing face engaging the second stationary bearing surface so as to permit rotational movement of the sleeve bearing relative to the second stationary bearing surface while restricting relative axial movement of the sleeve bearing.
10. The appliance as claimed in claim 8,
said stationary bearing surface being defined by a thrust washer.
11. The appliance as claimed in claim 8,
said stationary bearing surface being defined by a thrust washer,
said housing including an inlet flow guide and an outlet flow guide,
one of said flow guides supporting the thrust washer.
12. The appliance as claimed in claim 7,
said sleeve bearing including a radial bearing face engaging the shaft so as to permit rotational movement of the sleeve bearing relative to the shaft.
13. The appliance as claimed in claim 7,
said impeller including a substantially annular rim that is spaced radially from the sleeve bearing and supports the magnet.
14. The appliance as claimed in claim 13,
said impeller including a substantially annular hub that at least substantially circumscribes and is fixed to said sleeve bearing,
said blade extending between and interconnecting said hub and said rim.
15. The appliance as claimed in claim 7,
said pump further including an O-ring compressed by and frictionally engaging the shaft and the housing,
said O-ring at least substantially preventing rotation of the shaft relative to the housing.
16. The appliance as claimed in claim 15,
said O-ring being compressed by and frictionally engaging the stationary bearing surface.
17. The appliance as claimed in claim 1,
said housing including an inlet flow guide and an outlet flow guide,
each of said flow guides including a plurality of flow-diverting vanes.
18. The appliance as claimed in claim 1,
said rotor further including a stationary shaft,
said pump further including an O-ring compressed by and frictionally engaging the shaft and the housing,
said O-ring at least substantially preventing rotation of the shaft relative to the housing.
19. The appliance as claimed in claim 18,
said pump further including a stationary bearing surface,
said O-ring being compressed by and frictionally engaging the stationary bearing surface.
20. The appliance as claimed in claim 1,
said magnet circumscribing the primary flow path.
21. The appliance as claimed in claim 1,
said motor being a permanent magnet motor,
said magnet being a permanent magnet.
22. The appliance as claimed in claim 1,
said pump further configured such that fluid flows sequentially from the chamber, through the second flow conduit, and into the primary flow path.
23. The appliance as claimed in claim 1,
said rotor further including an elongated rotatable shaft that presents opposite ends,
said impeller fixed to the shaft for rotational movement therewith,
said impeller including a substantially annular rim that is spaced radially from the shaft and supports the magnet,
said pump further including a pair of bearing systems rotatably supporting the shaft on the housing, with each of the bearing systems being located adjacent a respective end of the shaft.
24. The appliance as claimed in claim 23,
said rotor further including a pair of rotatable bearing surfaces, wherein a first one of said rotatable bearing surfaces faces a first generally axial direction and the other other of said rotatable bearing surfaces faces a second generally axial direction that is at least substantially opposite the first generally axial direction,
each of said bearing systems including an axial bearing face engaging a respective one of the rotatable bearing surfaces so as to permit rotational movement of the corresponding rotatable bearing surface relative to the axial bearing face while restricting relative axial movement of the rotatable bearing surface.
25. The appliance as claimed in claim 24,
each of said rotatable bearing surfaces being defined by a thrust washer,
wherein said thrust washers are fixed to said impeller to rotate therewith.
26. The appliance as claimed in claim 23,
said impeller including a substantially annular hub that at least substantially circumscribes said shaft,
said blade extending between and interconnecting said hub and said rim.
27. The appliance as claimed in claim 23,
said impeller including a plurality of blades.
28. The appliance as claimed in claim 23,
said housing including an inlet flow guide and an outlet flow guide,
each of said flow guides including a plurality of flow-diverting vanes.
29. The appliance as claimed in claim 28,
said inlet flow guide supporting a first one of said bearing systems,
said outlet flow guide supporting a second one of said bearing systems.

* * * * *